US006910308B2

(12) United States Patent
Cadogan et al.

(10) Patent No.: US 6,910,308 B2
(45) Date of Patent: Jun. 28, 2005

(54) INFLATABLE RIGIDIZABLE BOOM

(75) Inventors: David P. Cadogan, Middletown, DE (US); Stephen E. Scarborough, Seaford, DE (US); John K. H. Lin, Middletown, DE (US); George H. Sapna, III, Seaford, DE (US)

(73) Assignee: ILC Dover LP, Frederica, DE (US)

( * ) Notice: Subject to any disclaimer, the term of this patent is extended or adjusted under 35 U.S.C. 154(b) by 0 days.

(21) Appl. No.: 10/358,126

(22) Filed: Feb. 4, 2003

(65) Prior Publication Data

US 2004/0148901 A1 Aug. 5, 2004

(51) Int. Cl.[7] ..... E04H 12/18
(52) U.S. Cl. ..... 52/646
(58) Field of Search ..... 52/2.18, 2.21, 52/108, 646, 649.6, 32.11, 2.19

(56) References Cited

U.S. PATENT DOCUMENTS

| | | | | | |
|---|---|---|---|---|---|
| 5,007,212 | A | * | 4/1991 | Fritts et al. | 52/2.18 |
| 5,154,027 | A | | 10/1992 | Warden | 52/108 |
| 5,311,706 | A | | 5/1994 | Sallee | 52/2.18 |
| 5,570,544 | A | * | 11/1996 | Hale et al. | 52/2.18 |
| 5,579,609 | A | | 12/1996 | Sallee | 52/2.11 |
| 5,651,848 | A | | 7/1997 | Cohee et al. | 156/92 |
| 5,893,237 | A | * | 4/1999 | Ryon et al. | 52/2.18 |
| 5,921,048 | A | | 7/1999 | Francom et al. | 52/637 |
| 6,213,995 | B1 | * | 4/2001 | Steen et al. | 604/527 |
| 6,260,306 | B1 | * | 7/2001 | Swetish et al. | 52/2.18 |
| 6,345,482 | B1 | | 2/2002 | Warren | 52/646 |
| 2003/0027474 | A1 | * | 2/2003 | Hayes | 442/149 |
| 2003/0151171 | A1 | * | 8/2003 | LeBreton et al. | 264/571 |

* cited by examiner

*Primary Examiner*—Anita King
*Assistant Examiner*—A. Joseph Wujciak
(74) *Attorney, Agent, or Firm*—Stevens, Davis, Millier & Mosher, L.L.P.

(57) ABSTRACT

A boom structure deployed by inflating the structure to a desired shape and rigidizing the structure via an external influence. The structure frame has a series of frame members which are made of a fibrous material and a resin material. This frame is encased in between a pair of membrane layers, an inner membrane inflatable to move the frame into its desired shape and an outer membrane that allows for folding the structure. Following inflation of the inner layer, an external influence acts on the resin material to solidify it, and render the structure rigid. The external influence may also act on the resin material to soften it when it is already rigid, to allow for collapsing and folding of the structure.

35 Claims, 7 Drawing Sheets

INFLATABLE RIGIDIZABLE BOOM

FIELD OF THE INVENTION

The invention relates to truss structures that are inflatable, rigidizable, and deployable adapted for space applications as well as ground applications.

BACKGROUND OF THE INVENTION

Truss structures have many applications, such as solar arrays, enclosures, antennas, telescopes, solar sails and other structures in space or supports for bridges, piers, buildings or antennas, whether under water or on land. Metal and rigid composite components with mechanical deployment systems were used in the initial stages of the technology development to manufacture support structures for space applications. These structures were massive and could not be packed efficiently for transport. In space applications, for example, their lack of packing efficiency resulted in increased launch vehicle size and mass, which consequentially led to higher system launch costs.

The inherent disadvantages of rigid element mechanically deployed systems led to the development of structures fabricated from ultra-lightweight materials that also utilized mechanical deployment schemes. Although these systems achieved significant mass reductions from earlier rigid element designs, they also have the disadvantages of complex deployment systems, which make them susceptible to a number of failure modes in space, as well as low packaging efficiencies. Strain energy deployed systems were developed to eliminate the complexity of mechanical deployment systems by using the strain energy of the ultra-light weight material for deployment. However, strain energy deployed systems have the disadvantage of severe material and structural damage due to folding.

Taking advantage of the light loading conditions in space, inflatable structures have been used for the structural support of components such as antennas, solar sails, telescopes and solar arrays because of their high packing and structural efficiency and relatively simple deployment process. An example of an inflatable support structure is disclosed in U.S. Pat. No. 5,311,706 (Sallee). However, the components in these structures require highly precise manufacturing processes and the materials used for these components, i.e., polymer films and fabrics, sometimes result in structures having a high coefficient of thermal expansion. These systems also rely on continuous pressurization and regulation of the inflation system in order to maintain the stiffness required to support the space structure. A further disadvantage inherent in this apparatus is limited structural stiffness. Inflatable systems are also subject to puncture from orbital debris, permeation of the inflation gas through the gas retaining layer, and loss of gas due to manufacturing defects, such as seam or joint leaks, and therefore have a limited lifetime and require constant monitoring of performance.

Alternative methods to the inflatable structures is to use a structure which is both inflatable and rigidizable, such as shown in U.S. Pat. No. 5,579,609 (Sallee). The truss design consists of a series of discrete members connected together and overlain on an inflatable MYLAR or KAPTON bladder to form various shapes when the bladder is inflated. Within each of the discrete members are a series of Kevlar or glass fibers and a binder surrounding a heating wire or core. Upon activation of the wire or core, heat is given off which activates the binder which hardens the member. However, such a design has the disadvantage that a large electrical system is required to activate the cores and wires and each member of the structure must be electrically interconnected. Further, use of discrete members for the structure reduces the strength of the structure by placing stress on the joints of the structure.

SUMMARY OF THE INVENTION

An object of this invention is to overcome the above mentioned disadvantages of the prior art truss devices by providing an inflatable, rigidizable structure that is highly efficient structurally and can be packed into significantly small volumes, comparable to inflatable structures, and hence achieve very high packing efficiencies while also capable of being deployed on command, to regain its original shape.

It is a further object of this invention to provide a structure that is simple in design, does not require complex mechanical systems for deployment, needs only a relatively low inflation pressure and can rigidized in space via one of several possible-rigidization techniques, such as elevated temperature, chemical exposure or radiation exposure in the electromagnetic spectrum.

It is another object of this invention to incorporate materials that yield highly efficient structural configurations with near zero coefficients of thermal expansion. This makes them suitable for use in harsh environmental conditions in space. Also, once rigidized these types of systems no longer rely on the inflation gas for structural support, which thereby reduces the chance that an impact with orbital debris could adversely affect the system.

The invention described herein carries out these objects, as well as others, and overcomes the shortcomings of the prior art by providing a rigidizable boom that can be incorporated into a truss structure that is lightweight, inflatable and rigidizable that can be collapsed into a small space for extended periods of time, can be inflated into a predetermined shape and made rigid by means external to the structure.

In a preferred embodiment, the boom comprises a combination of a frame encased between two layers of film. The frame is generally a cylindrical shape having longitudinal and helical members composed of a high modulus fiber/resin and can be folded and stored for a considerable length of time and when required and can be rigidized by providing heat energy, exposure to the chemical constituents of the inflation gas, or exposure to particular wavelengths of electromagnetic radiation. With the use of a memory shape polymer in the fiber/resin, the members can be repeatedly heated, reformed and cooled to alter the boom's shape as needed. The means of rigidization are dependent on the resin system that is utilized for fabricating the boom. The boom can be stored in various environmental conditions such as extreme hot and cold temperatures and high and low humidity depending on the resin system that is used in manufacture.

The arrangement of the helical and longitudinal members are arranged to form a circular grid structure. Both groups of longitudinal members extend along the length of the boom, for example, the longitudinal members extend directly from one end to the other while the helical members extend spirally around the structure from one end to the other. The members are joined at the crossover points to provide a rigid structure. In the preferred embodiment, the crossings of the members create equilateral triangles that give the boom isotropic performance properties.

The film on the inside of the boom acts as a gas-retaining layer to facilitate the inflation at the time of deployment, while the outside layer prevents the isogrid boom from adhering to itself during the folding and packing procedure. The outside layer can also be used to form a shield to protect the boom from adverse environmental conditions as required, or can be a platform for distributing thin film electronic assemblies such as thin film membrane antennae and electronic circuits.

BRIEF DESCRIPTION OF THE DRAWINGS

Other embodiments, features and advantages of the invention described herein will occur to those skilled in the art from the following description of a preferred embodiment and the accompanying drawings, in which.

DETAILED DESCRIPTION OF A PREFERRED EMBODIMENT OF THE INVENTION

The preferred embodiment of the invention is a result of the need for a load carrying structure that is capable of being packaged into a reasonably small volume and can be deployed on command, to regain its original shape. Since the matrix can be softened for packaging, the boom is foldable around a very small radius without damage to achieve a bend ratio (fold radius to material thickness) of less than 3. The deployed volume to packed volume ratio achieved by this methodology of material selection, manufacturing and packing is 28 or higher indicating a high packing efficiency. The boom is a cylindrical, isogrid structure that has quasi-isotropic properties. It is a composite system, which is composed of a high modulus fiber/resin that can be folded and stored for a considerable length of time and when required, is deployed via a simple inflation system to form a rigid structure. The boom may then be rigidized by providing heat energy, exposure to the chemical constituents of the inflation gas, or exposure to particular wavelengths of electromagnetic radiation.

Figure 1:
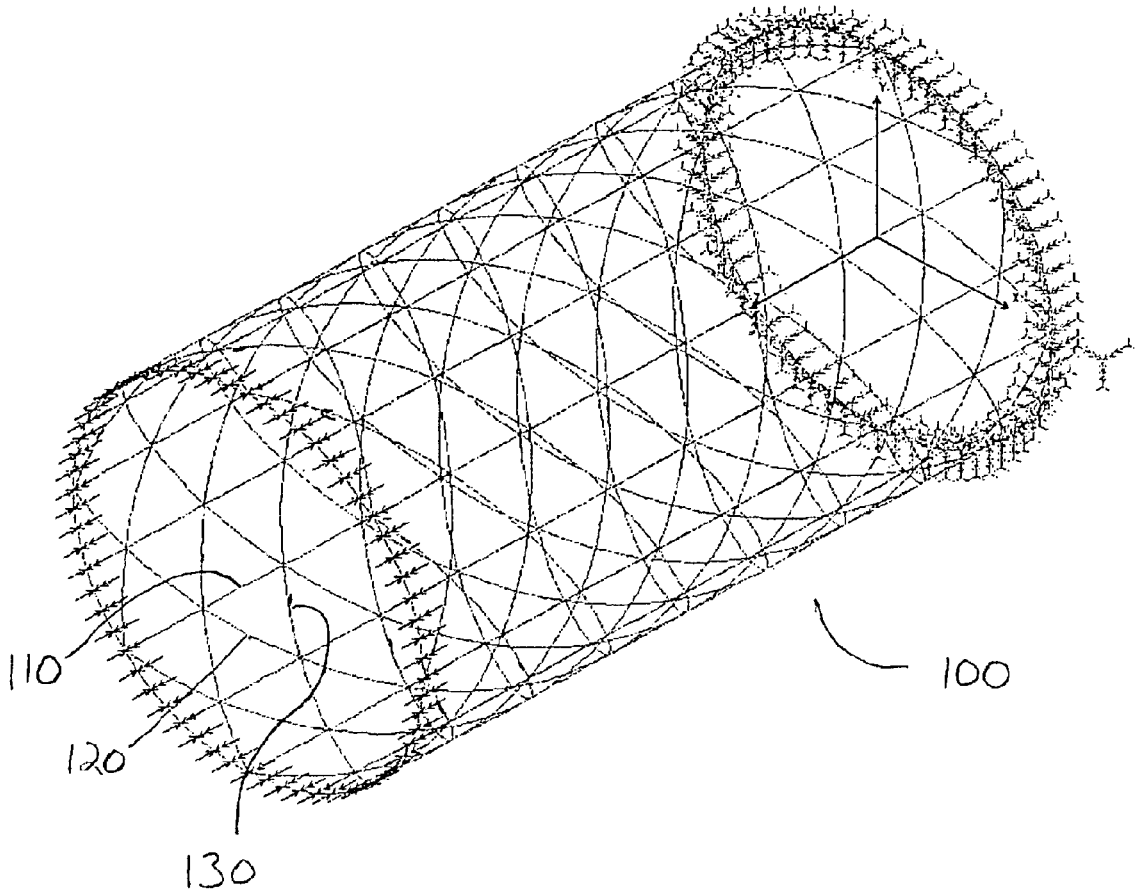
FIG. 1 is a perspective view of an isotropic arrangement of the boom frame of the preferred embodiment of the invention.
Figure 2:
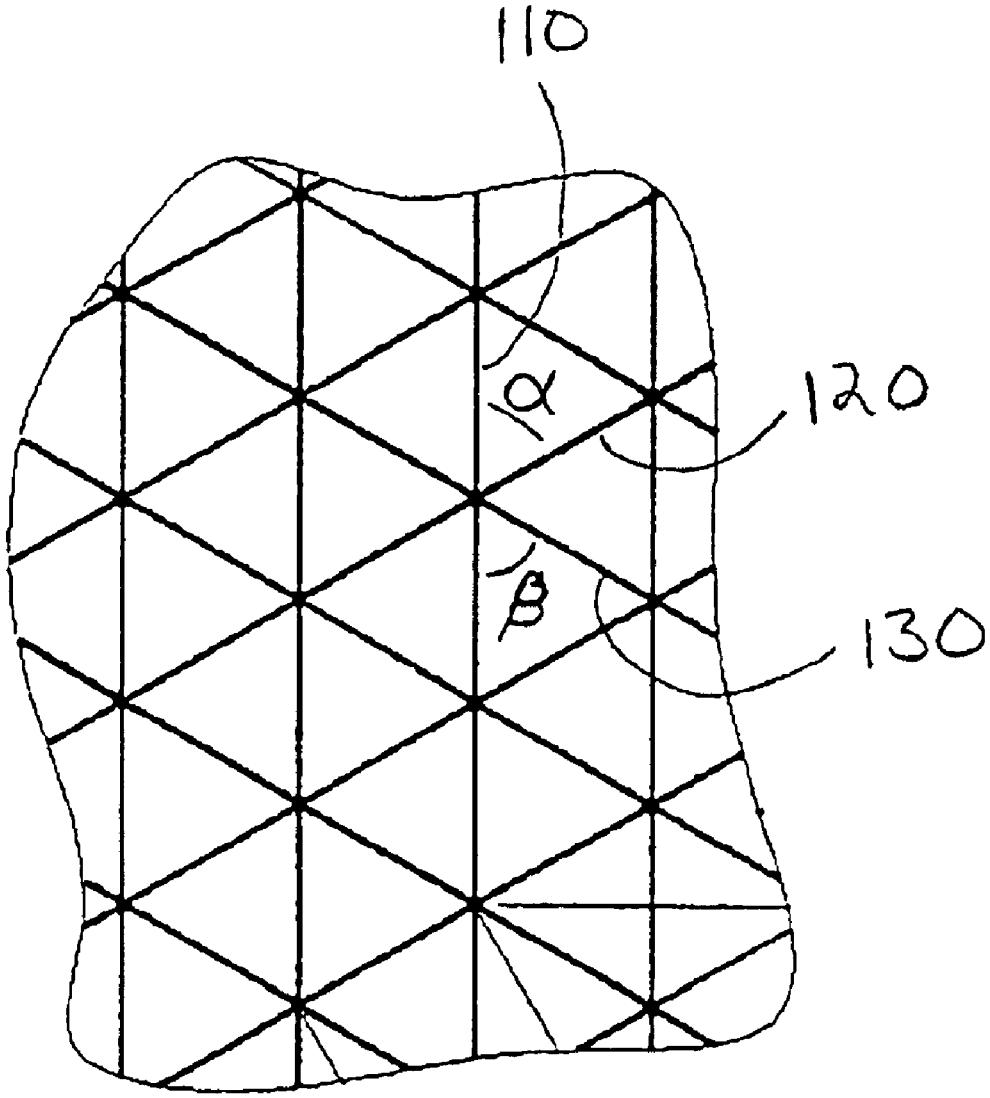
FIG. 2 is another view of the boom frame shown in FIG. 1.

The strength of the boom is derived from the isogrid structure created by careful arrangement of the frame members of the boom. In FIG. 1 there is shown a structural frame 100 of the boom. Frame 100 has a general cylindrical shape with a series of horizontal members 110 extending along the radial surface of the frame in the direction of Z. Crossing horizontal members 110 at an angle are a series of helical members 120, oriented at an angle $\alpha$ to the horizontal member. A second set of helical members 130, cross horizontal member at a second angle $\beta$. Each of helical members 120 and 130 spiral along the radial surface of frame 100, but one in the clockwise direction and the other in a counter clockwise direction. When the intersection angles $\alpha$ and $\beta$ are made 60°, isosceles triangles are create between the members 110, 120 and 130. Such forms the frame into a isogrid frame. Such an arrangement is shown in FIG. 2.

While isosceles triangles are disclosed in this preferred embodiment, various other arrangements between members 110, 120 and 130 are possible. For example, other triangles, rectangles, parallelograms, other polygons, etc. are also possible arrangements. Such arrangements may be required to carry out a specific parameter required by the application of the boom. Further, the boom need not be a round cylinder, other shapes such as a square-shaped tube, octagonal-shaped tube, etc. may be used in lieu thereof.

The material of the horizontal and helical members is generally a composite, comprising a combination of at least a fiber having a high tensile, flexural and compression modulus and a shape memory polymer, which acts as a thermoplastic material that can be repeatedly heated, reformed and cooled to alter the structural shape. The fiber may comprise graphite, carbon fiber, Kevlar with added graphite, liquid crystal polymer, glass, or other high strength material having the above-mentioned properties. The shape memory polymer may be nylon, PEEK, polyethylene, polypropylene, polyurethane or epoxy which is interspersed with the fiber material. Such materials are chosen such that on application heat energy, exposure to chemical constituents of gas or inflation gas or exposure to particular wavelengths of electromagnetic radiation, the material either rigidifies after being in a flexible state or softens into a flexible state after being in a rigid state. In the preferred embodiment, the horizontal and helical members are made of a graphite/epoxy material that can rigidify on application of on of the energy sources listed above. A boom having the above properties allows for a frame structure which can be rigidified for use, followed by a second application of energy which allows for the frame structure to be collapsed.

The appropriate selection of the fibers and resin that constitute the horizontal and helical members enables the frame to be operational over a wide temperature range. Further, the fibers themselves can be made to be multi-functional through the use of embedded fibrous power generation and storage sources, electronic signal carrying metal or metalized fibers in the reinforcement, or fibers with distributed processing and sensor capability.

Figure 3:
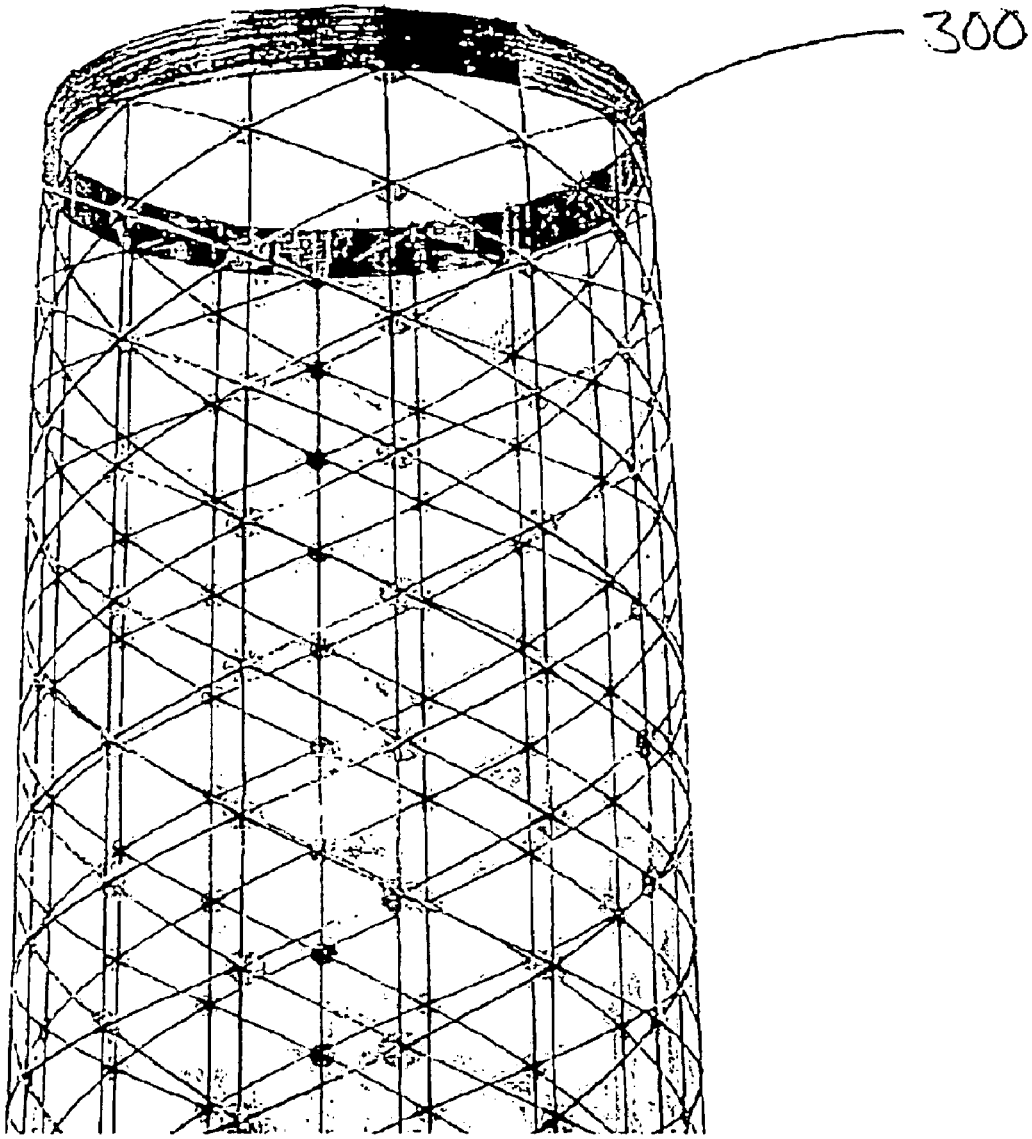
FIG. 3 is a view of the boom according to the preferred embodiment.

The isogrid frame is extremely lightweight due to its open construction and therefore requires additional reinforcements to maintain its structural stability through its repeated folding, packaging and deploying for ground testing and actual use. Therefore, helical and longitudinal members 110, 120 and 130 are connected at their crossover junctions, referred to as nodes, by junction clamps 300 (shown in FIG. 3) to keep the boom frame dimensionally and structurally stable. Junction clamps 300 can be achieved by a number of techniques, including sandwiching the nodes by fiber-reinforced thermosetting adhesive (shown), a hot melt adhesive or using mechanical attachments to hold the nodes in place. Junction clamps 300 may also be made from the same material as helical and longitudinal members 110, 120 and 130. Any such composition or attachment would work as long it allows junction clamps 300 to fold along with the rest of boom frame 100. Additionally, junction clamps 300 in FIG. 3 are shown to be circular and of a particular size, but any such size or shape can be used but should correspond to the particular use and parameters of the boom frame.

Figure 4:
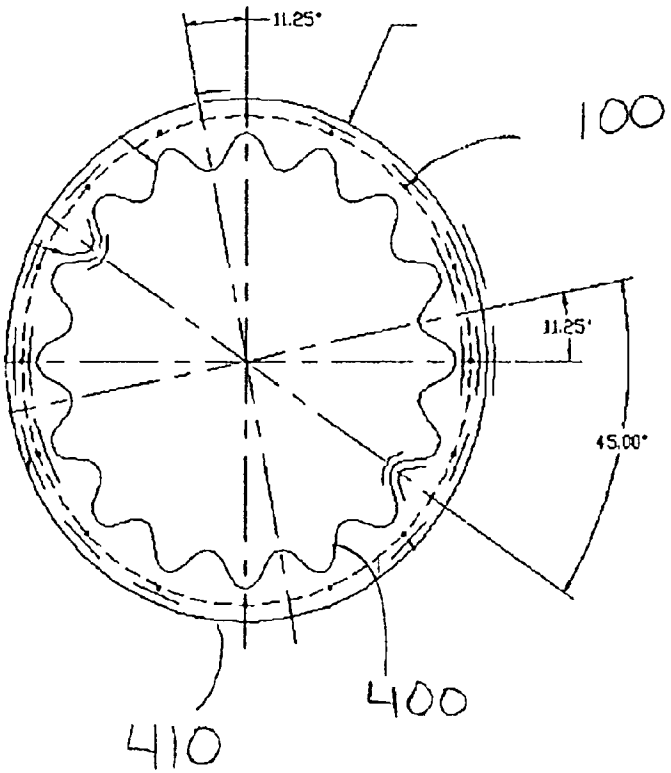
FIG. 4 is a cross-sectional view of the boom shown in FIG. 3.

In FIG. 4, a cross section of a boom 1 is shown, having incorporated therein frame 100. Layers, inner layer 400 and outer layer 410, are applied to the inner surface of the frame and the outside of the frame, respectively. Each layer, 400 and 410, is connected to frame 100 or the other layer via an adhesive. The layers comprise a polyimide film that exhibits a balance of physical, chemical and electrical properties over a wide temperature range, specifically high temperatures. The makeup of the polyimide is a result of a polycondensation reaction between pyromellitic dianhydride and 4,4 diaminodiphenyl ether. An example of this polyimide is sold by E. I. DuPont De Nemours and Company, Inc., of Wilmington Del., under the trademark KAPTON. While polyimide is used in the preferred embodiment of this invention, other materials may be used that exhibit similar properties and provide similar results in their application.

Inner layer 400 connected to the frame has a diameter that corresponds to the inner layer of the frame 100 and a thickness of about 1 mil. Inner layer acts as a gas-retaining layer to facilitate the inflation at the time of deployment of boom 1.

Outer layer 410 surrounds the frame and is attached to inner layer 400 to provide sandwich structure. It has a thickness of about 0.3 mil. Outer layer 410 prevents boom 1 from adhering to itself during the folding and packing of the boom. Additionally, outer layer 410 can be used as a shield to protect the structure from adverse environmental conditions as required, or can be a platform for distributed thin film electronic assemblies such as thin film membrane and electronic circuits.

The boom also includes end reinforcements 300 (FIG. 3) at both of its ends for structural stabilization, which are either formed of similar material as layers 400 and 410, but can also be composed of a fiber/resin system similar to the structure, but possess a greater areal density than the boom itself. Since reinforcements 300 are open in construction and are manufactured from materials with low or negative coefficients of thermal expansion, they exhibit very low susceptibility to damage due to repeated folding, packaging, and deployment, and have excellent dimensionally stability.

Figure 5:
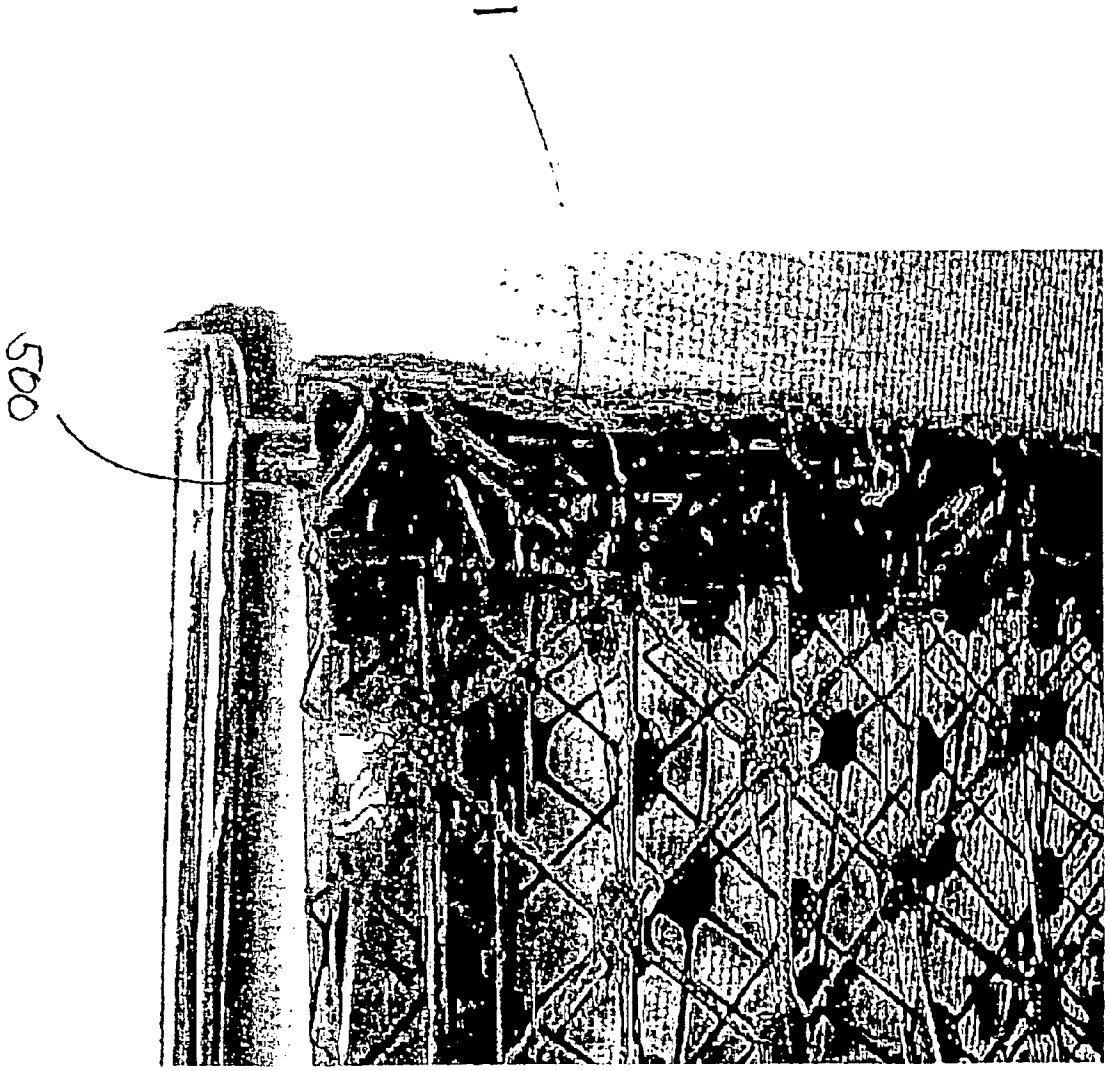
FIG. 5 is a perspective view of the boom shown in FIG. 3 folded about an axis.
Figure 6:
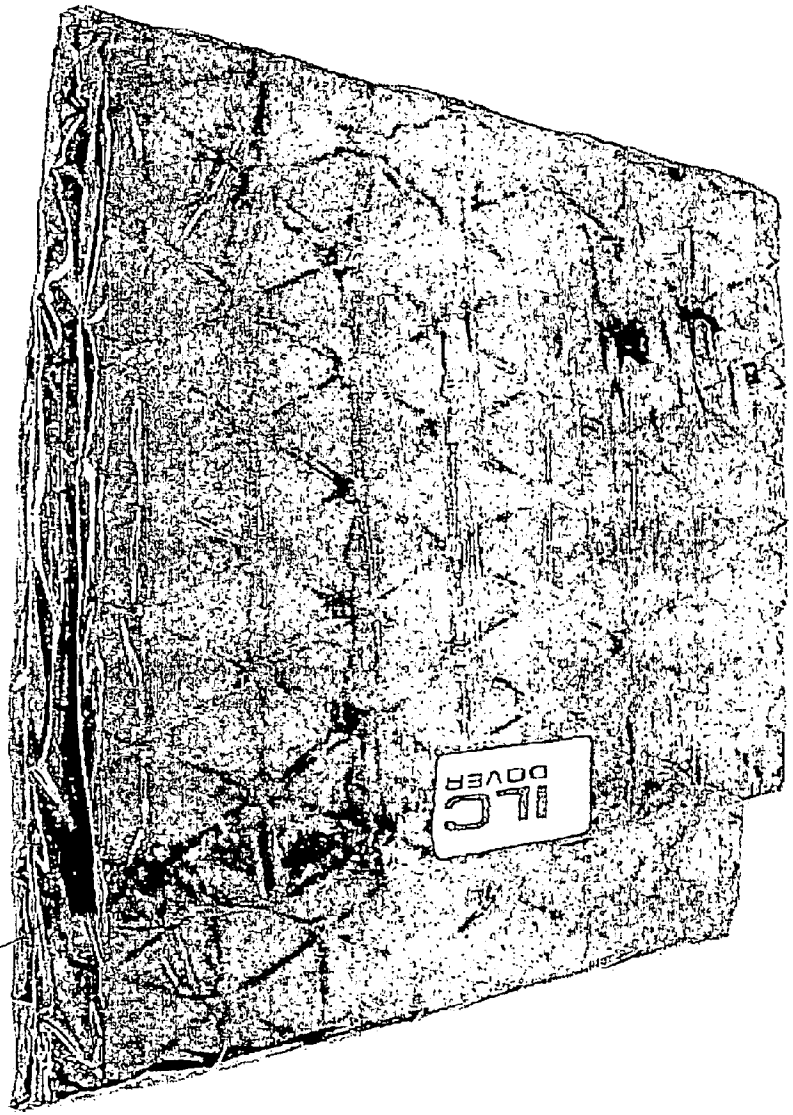
FIG. 6 is a perspective view of the boom shown in FIG. 3 folded flat.

Boom 1, according to the above description, has the properties of being foldable into a compact volume to allow easy storage prior to and after deployment. The boom is preferably folded into a flat sheet before it is stored. The folding takes place around a small diameter 500, as shown in FIG. 5, which allows tight packing of the boom. Because of the materials used as outlined above, damage does not occur during such folding. The diameter around which the boom is folded and the number of times the boom is folded will depend on the packaging volume and system requirements. FIG. 6 depicts an example of the boom in a folded state. The method of folding shown is a Z-folding, where each successive fold is in an opposite direction as the previous fold. Other folding methods are also possible. Such method allows the boom to be folded into a relatively flat and narrow storage space. This leads to a very high ratio of deployed to packed volume which can serve as a major advantage as it reduces launch costs should the boom be designed to be deployed in space.

A sequence of operation using the above-described boom will now be outlined. The deployment sequence, whether in space, on land or underwater, takes place via a simple mechanism and steps. The boom is first placed in its intended position or in the vicinity thereof. If the boom is Z-folded, only the inflation end need be in the desired place as the rest of the boom will move to the proper location during inflation. The inner layer is then inflated with gas, which causes it to expand within the frame. As the frame expands it begins to achieve the desired shape, which for this embodiment is an elongated boom. At reaching desired inflation of the frame and inner layer, the introduction of the gas is terminated.

The hardening of the materials in the frame then begins. As mentioned above, the helical and horizontal members may be either heated via radiation or exposed to suitable wavelengths of the electromagnetic spectrum via emitters (not shown), which may be attached to a ship, or it may be a mobile device moved about the boom after inflation. Following exposure to these influences, the shape memory polymers will begin to harden. Alternatively, the gas used to inflate the inner layer of the boom may also have a reactant that causes the matrix resin to harden during and following inflation. The means of rigidization will depend on the resin used in the boom construction. Once the helical and horizontal members harden, the frame becomes rigid which in turn rigidizes the boom.

Figure 7:
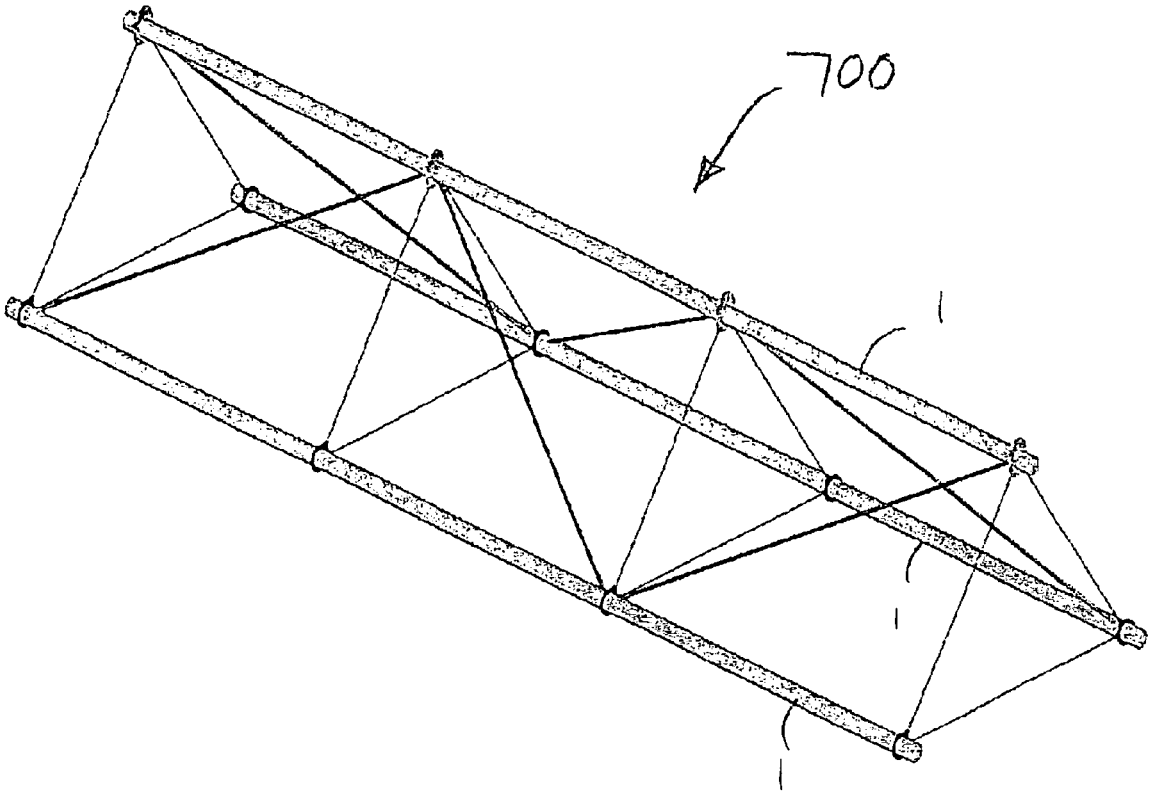
FIG. 7 is a perspective view of the boom incorporated into a truss structure.

The boom in a rigid state can be used as a support structure for antennas, solar sails, telescopes and solar arrays in space, as well as rigidizable supports for bridges, piers, buildings or antennae on land or underwater. Other applications obvious to those having ordinary skill in the art are also possible. FIG. 7 shows an application three booms 1 incorporated into a truss structure 700, which is itself foldable and deployable through a mechanism of inflation. Truss 700 comprises several support members integrated with the booms 1. The entire truss 700 can be collapsed by folding the structure and then resurrected by inflating the booms that forces truss to be deployed. Such is possible using a system of fibers and shape memory polymers which allow truss 700 to be deployed and folded multiple times. The boom may also be incorporated likewise into larger and more complex truss and other structures.

Although the present invention has been described and illustrated in detail, such explanation is to be clearly understood that the same is by way of illustration and example only, and is not to be taken by way of limitation. Other modifications of the above examples may be made by those having ordinary skill in the art which remain within the scope of the invention. For instance, the examples are described with reference to a cylindrical boom shape. However, various other structures are possible using the invention, such as a ground enclosure, a round structure, or a dome.

Further, other applications of the invention are possible. For instance, many booms according to this invention can be interconnected to form a large frame for a space station, or to create passageways on land sealed from the outer environment. Such applications are possible by simply connecting the frames, inner and outer layers together to form large boom structures. Other embodiments and applications are likewise possible to those having ordinary skill in the art.

We claim:

1. An inflatable and rigidizable structure comprising:

a foldable frame having a predetermined shape comprising a plurality of longitudinal frame members and at least one helical frame members; each of said frame members extending a length of the frame; each of said frame members made of a matrix that is activated to harden or soften upon application of an external influence, wherein the longitudinal frame members and said at least one helical frame members are connected together at crossover points in a grid pattern via nodal connections; and an inflatable inner membrane located inside the frame that expands to move the foldable frame into the predetermined shape, wherein upon application of the external influence following an inflation of the inflatable membrane, the structure is rigidized.

2. The inflatable and rigidizable structure as described in claim 1 further comprising an outer membrane covering the foldable frame.

3. The inflatable and rigidizable structure as described in claim 2, wherein the inner and outer membranes are made of a thin polymeric film.

4. The inflatable and rigidizable structure as described in claim 3, wherein the thin polymeric film is polyimide.

5. The inflatable and rigidizable structure as described in claim 3, wherein the inner membrane is 0.5–2.0 mil thick and the outer membrane is 0.3–1.0 mil thick.

6. The inflatable and rigidizable structure as described in claim 2, wherein the foldable frame is incased between the inner and outer membranes.

7. The inflatable and rigidizable structure as described in claim 1, wherein the structure folds into a volume smaller than a volume of the structure when the structure is deployed via inflation of the inner membrane and application of the external influence.

8. The inflatable and rigidizable structure as described in claim 1, wherein the frame members comprise a fiber material and a resin material.

9. The inflatable and rigidizable structure as described in claim 8 wherein the resin material is a thermoplastic material made of a combination of one or more of the materials selected from a group consisting of nylon, polyetheretherketone, polyethylene, polypropylene polyurethane and epoxy.

10. The inflatable and rigidizable structure as described in claim 8 wherein the fiber material is made of one or more materials selected from the group of graphite, carbon fiber, composite plastic, liquid crystal polymer and glass.

11. The inflatable and rigidizable structure as described in claim 8 wherein the resin material is one of thermosetting resin, shape memory resin, thermoplastic resin, UV curable resin and solvent-based resin.

12. The inflatable and rigidizable structure as described in claim 11 wherein the external influence is heat energy, exposure to chemical constituents of a gas or inflation gas or exposure to particular wavelengths of electromagnetic radiation.

13. The inflatable and rigidizable structure as described in claim 1, wherein the foldable frame has an equal number of helical and longitudinal members.

14. The inflatable and rigidizable structure as described in claim 13, wherein the helical and longitudinal members are arranged to form a polygonal grid pattern.

15. The inflatable and rigidizable structure as described in claim 14, wherein the helical and longitudinal members are arranged to form an equilateral triangle grid pattern.

16. The inflatable and rigidizable structure as described in claim 1, wherein each nodal connector is a fiber-reinforced thermosetting adhesive, a hot melt adhesive or a mechanical attachment.

17. The inflatable and rigidizable structure as described in claim 1, wherein the structure is incorporated into a larger assembly.

18. The inflatable and rigidizable structure as described in claim 2, wherein the structure has mounted therein one or more components selected from the group consisting of conductive fibers, circuit elements, integrated circuits, light emitting diodes, solar cells, antennas, embedded controllers and artificial muscle fibers.

19. The inflatable and rigidizable structure as described in claim 2, wherein the structure has reinforcement elements at ends thereof connecting to the frame members and the inner and outer membranes.

20. A method for deploying and storing a structure having a foldable frame with a predetermined shape comprising a plurality of longitudinal frame members and at least one helical frame member extending a length of the frame each made of a matrix that is activated to harden or soften upon application of an external influence, wherein the longitudinal and said at least one helical member are connected together at crossover points via nodal connectors, an inflatable membrane located inside the frame that expands to move the foldable frame into the predetermined shape and an outer membrane encasing the foldable frame in conjunction with the inner membrane, said method comprising:

(a) placing a portion of the structure in a desired location;

(b) inflating the inflatable membrane with a gas until the frame is moved into the predetermined shape; and (c) applying the external influence to the structure to rigidify the frame members.

21. The method as described in claim 20 further comprising the steps of:

(e) reapplying the external influence to soften the frame members; and (f) collapsing the structure into a flat shape for storage.

22. The method as described in claim 21 further including the step of:

(g) folding the flat shaped structure about a small diameter causing the structure to overlap itself.

23. The method as described in claim 22 wherein the step of folding includes alternatively folding the flat shaped structure about the small diameter at least two times.

24. The method as described in claim 23, wherein flat shaped structure has a generally Z-shaped folding pattern.

25. The method as described in claim 21 wherein the steps of applying and reapplying the external influence includes a device outside the structure heating the structure, propagating particular wavelengths of electromagnetic radiation towards the structure or exposing the structure to chemical constituents of a gas.

26. An inflatable and rigidizable structure comprising:

a foldable frame having a predetermined shape comprising a plurality of frame members extending a length of the frame forming a grid pattern, each made of a matrix that is activated to harden or soften upon application of an external influence wherein the frame members are connected together at intersections in the grid pattern via nodal connectors;

an inner inflatable membrane located inside the frame that expands to move the foldable frame into the predetermined shape, and an outer membrane encasing the foldable frame in conjunction with the inner membrane wherein upon application of the external influence following an inflation of the inflatable membrane, the structure is rigidized and upon application of the external influence while the structure is rigidized, the structure is softened allowing folding of the structure.

27. The inflatable and rigidizable structure as described in claim 26 wherein the external influence is heat energy, exposure to chemical constituents of a gas or inflation gas or exposure to particular wavelengths of electromagnetic radiation.

28. The inflatable and rigidizable structure as described in claim 27, wherein the frame members comprise a fiber material and a resin material.

29. The inflatable and rigidizable structure as described in claim 28 wherein the resin material is a thermoplastic material made of a combination of one or more of the materials selected from a group consisting of nylon, polyetheretherketone, polyethylene, polypropylene, polyurethane and epoxy.

30. The inflatable and rigidizable structure as described in claim 28 wherein the fiber material is made of one or more materials selected from the group of graphite, carbon fiber, composite plastic, liquid crystal polymer and glass.

31. The inflatable and rigidizable structure as described in claim 26 wherein the grid pattern forms equilateral triangles.

32. The inflatable and rigidizable structure as described in claim 26, wherein the structure has reinforcement elements at ends thereof connecting to the frame members and the inner and outer membranes.

33. The inflatable and rigidizable structure as described in claim 26, wherein each nodal connector is a fiber-reinforced thermosetting adhesive, a hot melt adhesive or a mechanical attachment.

34. The inflatable and rigidizable structure as described in claim 26, wherein the inner and outer membranes are made of a polymeric resin.

35. The inflatable and rigidizable structure as described in claim 34, wherein the polymeric resin is polyimide.

* * * * *